US007546686B1

(12) United States Patent
Norman

(10) Patent No.: US 7,546,686 B1
(45) Date of Patent: Jun. 16, 2009

(54) DRAWING APPARATUS

(75) Inventor: Casey William Norman, Andoversford (GB)

(73) Assignee: Genie Toys PLC (GB)

( * ) Notice: Subject to any disclaimer, the term of this patent is extended or adjusted under 35 U.S.C. 154(b) by 0 days.

(21) Appl. No.: 11/949,457

(22) Filed: Dec. 3, 2007

(51) Int. Cl.
*B43K 21/00* (2006.01)
*B43L 11/00* (2006.01)

(52) U.S. Cl. ..... 33/27.01

(58) Field of Classification Search ..... 33/27.01, 33/18.1, 26, 27.07, 27.08, 27.09, 27.11, 30.1, 33/30.2, 30.4
See application file for complete search history.

(56) References Cited

U.S. PATENT DOCUMENTS

| | | | | | |
|---|---|---|---|---|---|
| 2,497,418 | A | * | 2/1950 | Schroeder, Jr. | 401/48 |
| 3,297,003 | A | * | 1/1967 | Benson | 33/27.11 |
| 3,330,041 | A | * | 7/1967 | Dupler | 33/18.1 |
| 3,390,460 | A | * | 7/1968 | Brown et al. | 33/27.01 |
| 3,538,607 | A | | 11/1970 | Montague | |
| 3,638,319 | A | * | 2/1972 | Barlow et al. | 33/18.1 |
| 3,872,596 | A | * | 3/1975 | Pardubsky | 33/27.11 |
| 4,211,012 | A | * | 7/1980 | Alles et al. | 33/18.1 |
| 4,419,041 | A | * | 12/1983 | Rose | 414/739 |
| 4,599,799 | A | * | 7/1986 | Lopez | 33/18.1 |
| 4,825,556 | A | * | 5/1989 | Goldfarb | 33/27.11 |
| 4,835,874 | A | * | 6/1989 | Ellman et al. | 33/27.11 |
| 5,208,987 | A | * | 5/1993 | Christen | 33/18.1 |
| 5,933,970 | A | * | 8/1999 | Diresta | 33/27.01 |
| 2007/0135016 | A1 | | 6/2007 | Ihara | |

FOREIGN PATENT DOCUMENTS

| | | |
|---|---|---|
| DE | 1 461 563 A1 | 1/1969 |
| JP | 9-24164 A | 1/1997 |

* cited by examiner

*Primary Examiner*—Christopher W Fulton
(74) *Attorney, Agent, or Firm*—DLA Piper LLP (US)

(57) ABSTRACT

A drawing apparatus is provided having a housing, a rotating mechanism and a drawing mechanism. The housing has a circumferential ring gear located within an interior portion of the housing. The rotating mechanism is rotatably mounted within the housing and has a motor operatively connected to a drive gear. The drive gear rotates about a drive axis and is positioned for engagement with the ring gear. The drawing mechanism is pivotally mounted on the rotating mechanism, and has a drawing implement holder connected to the drive gear by a connector. The connector is mounted to a portion of the drive gear that is spaced away from the drive axis. Upon rotation of the rotating mechanism with respect to the housing, the drawing implement holder mechanism pivots with respect to the rotating mechanism. Also provided is a method of drawing using such drawing apparatus.

20 Claims, 4 Drawing Sheets

DRAWING APPARATUS

TECHNICAL FIELD

This technical disclosure relates generally to apparatus used for drawing.

BACKGROUND

Drawing apparatus have been used for years to create patterns with a drawing implement. In some instances, a drawing implement is inserted into the apparatus and a user will move the apparatus to create a pattern. Generally, such devices are configured to create a single pattern. A need exists for a drawing apparatus that will facilitate a creation of a number of patterns from the same device and allow writing implements to be interchanged during operation. A further need exists for a drawing apparatus that will automatically create a pattern without input from a user.

SUMMARY

A drawing apparatus is provided having a housing, a rotating mechanism and a drawing mechanism. The housing has a circumferential ring gear located within an interior portion of the housing. The rotating mechanism is rotatably mounted within the housing and has a motor operatively connected to a drive gear. The drive gear rotates about a drive axis and is positioned for engagement with the ring gear. The drawing mechanism is pivotally mounted on the rotating mechanism, and has a drawing implement holder connected to the drive gear by a connector. The connector is mounted to a portion of the drive gear that is spaced away from the drive axis. Upon rotation of the rotating mechanism with respect to the housing, the drawing implement holder mechanism pivots with respect to the rotating mechanism.

Further provided is a drawing apparatus having a base, a cover portion, a rotating mechanism and a drawing mechanism. The base has a circumferential ring gear located within an interior portion of the base and is adapted for engagement with a supporting surface. The cover portion is adapted to mate with the base and has an aperture extending therethrough. The rotating mechanism is rotatably mounted within an interior cavity formed by the base and cover portion. The rotating mechanism has a motor mechanically connected to a drive gear, which rotates about a drive axis and is positioned for engagement with the ring gear. The drawing mechanism is pivotally mounted on the rotating mechanism and has a drawing implement holder mounted adjacent the aperture extending through the cover portion. The drawing implement holder is connected to the drive gear by a pushrod mounted on a portion of the drive gear spaced away from the drive axis. Upon rotation of the rotating mechanism with respect to the base, the drawing implement holder mechanism pivots with respect to the rotating mechanism.

Also provided is a method of drawing. In the method, a drawing apparatus is provided having a shell, a rotating mechanism and a drawing implement holder. The rotating mechanism is mounted within the shell for rotation with respect to the shell. The drawing implement holder is pivotably mounted on the rotating mechanism and pivots with respect to the rotating mechanism. The rotating mechanism powered by a motor that is activated when a lower portion of the rotating mechanism engages a supporting surface. The method further includes the steps of inserting a drawing implement into the drawing implement holder and placing the drawing apparatus on a supporting surface, thereby activating the motor and facilitating rotation of the rotating mechanism and pivoting of the drawing implement holder.

DETAILED DESCRIPTION

Figure 1:
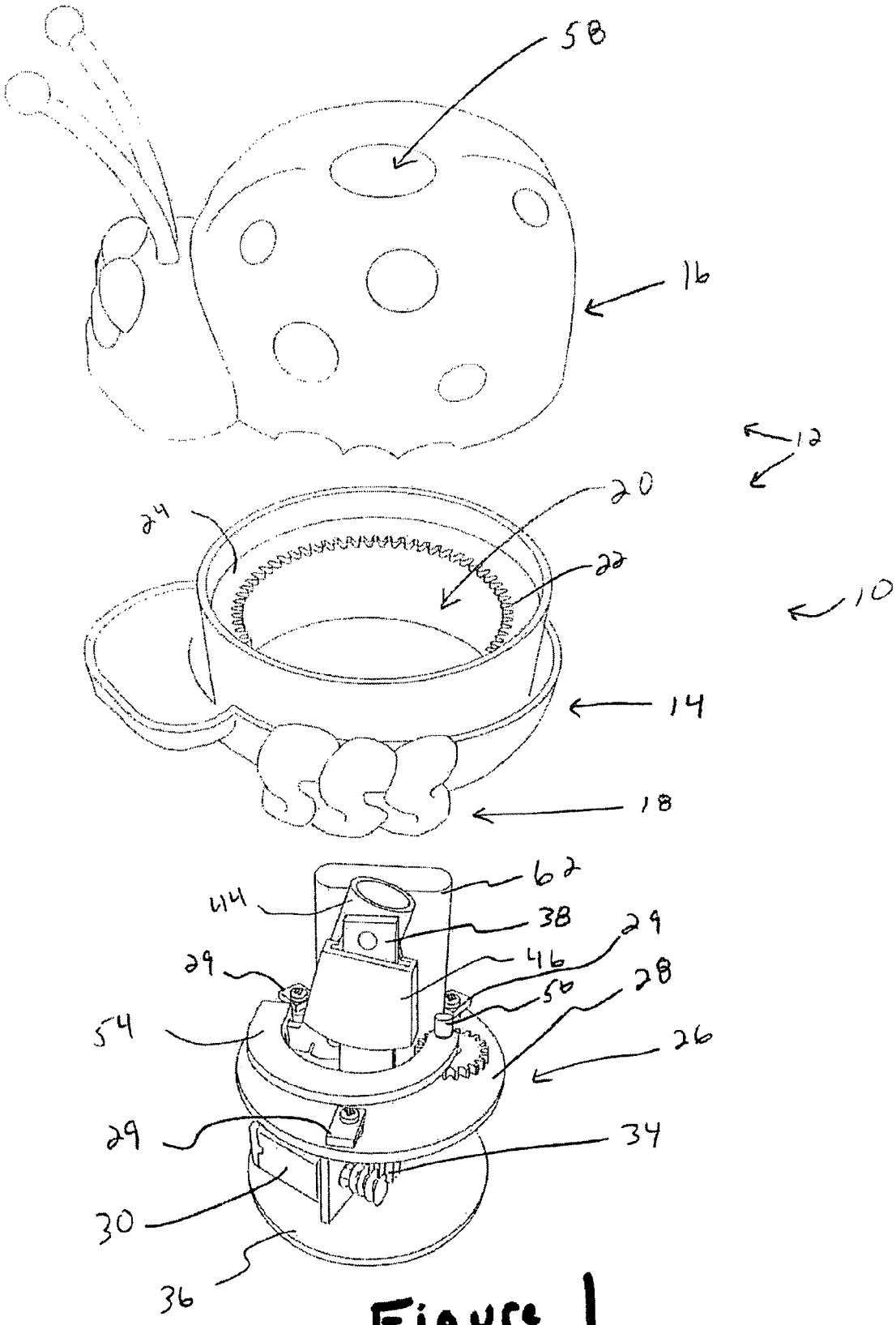
FIG. 1 is an exploded perspective view of a drawing apparatus.

It will be appreciated that the following description is intended to refer to specific examples of structure selected for illustration in the drawings and is not intended to define or limit the disclosure, other than in the appended claims.

A drawing apparatus is shown in the drawings. The drawing apparatus is preferably used to create markings on a supporting surface. Generally, the supporting surface is some type of paper although a variety of other types of supporting surfaces may be used. Wood, cardboard, paper board and the like are representative examples. A drawing implement is generally inserted into the drawing apparatus to create the markings.

FIG. 1 shows a drawing apparatus 10. The drawing apparatus 10 preferably has a two piece housing 12 having a base 14 and a cover portion 16. In the representative structure shown, the housing is configured to resemble an insect, namely a ladybug. Accordingly, the base 14 has a plurality of legs 18 adapted to engage a supporting surface. Although a ladybug is shown here, the drawing apparatus 10 may be configured to resemble any type of object, including but not limited to various animals, vehicles or other figures. Also, although the housing 12 is shown with a base 14 and a cover portion 16, the housing may be of unitary construction, or may comprise only a base or a cover portion.

The base 14 has a generally hollow interior cavity 20 with a generally circular profile. A circumferential ring gear 22 is located on the interior wall of the base 14. Preferably, the ring gear 22 projects inwardly from the wall of the base 14, thereby creating a ridge 24 that is adapted to be generally parallel to the supporting surface. Although the ring gear 22 is shown here within the base 14, the ring gear 22 may be disposed within the cover portion 16 or, in the case of a one-piece housing, within the housing generally.

Figure 4:
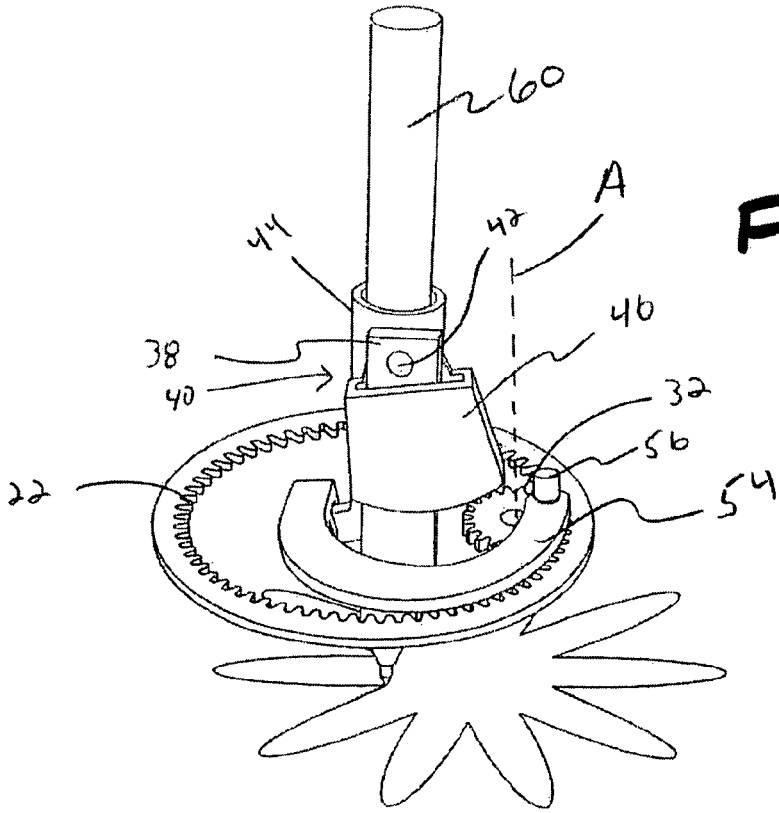
FIG. 4 is a perspective view a portion of the drawing apparatus of FIG. 1 shown with markings made on a supporting surface.

A rotating mechanism 26 is mounted within the housing 12 for rotation with respect to the housing 12. The rotating mechanism 26 has a first plate 28 having a radius slightly smaller than the interior diameter of the base 14 portion of the housing 12. A motor 30 is mounted on the rotating mechanism 26 and is mechanically connected to a drive gear 32. The drive gear 32 is preferably mounted on the first plate 28 and positioned for toothed engagement with the ring gear 22. As seen in FIG. 4, the drive gear rotates about a drive axis "A."

The rotating mechanism is retained within the base 14 by retaining the ring gear 22 between the first plate 28 and a series of retaining tabs 29. The retaining tabs 29 and first plate 28 retain the gear 22 and ridge 24 therebetween. Both the retaining tabs 29 and first plate 28 are adapted to slide along the ring gear 22 and ridge 24 without catching on the teeth of the ring gear 22 or any other protrusion. Where the housing is one piece, the rotating mechanism may be inserted from the bottom and retained within the housing by rotating the retaining tabs 29 to extend above the ring gear 22, thereby retaining the ring gear between the retaining tabs 29 and the first plate 28.

Referring now to FIGS. 1 and 4, the motor 30 is preferably linked to the drive gear 32 by a series of gears 34, some of which are shown. The gears transfer rotational motion of the motor's output shaft to the drive gear 32 to facilitate rotation of the drive gear 32 and thus the entire rotating mechanism 26. In the representative structure shown, a second plate 36 is positioned below the first plate 28 and fixedly connected thereto by a shaft (not shown). One of the gears 34 is preferably mounted for rotation about the shaft. The motor 30 is mounted on the bottom side of the first plate 28. However, the motor 30 may be also mounted on the second plate 36 or both plates.

Referring now to FIGS. 1-4, a drawing shaft 38 extends upwardly from the first plate 28. A drawing mechanism 40 is pivotally mounted to the drawing shaft 38 by a pivot pin 42. The drawing mechanism 40 pivots about a pivot axis B (shown in FIG. 5). The drawing mechanism 40 preferably comprises a drawing implement holder 44 and an adjusting connector, such as an adapter 46.

Figure 5:
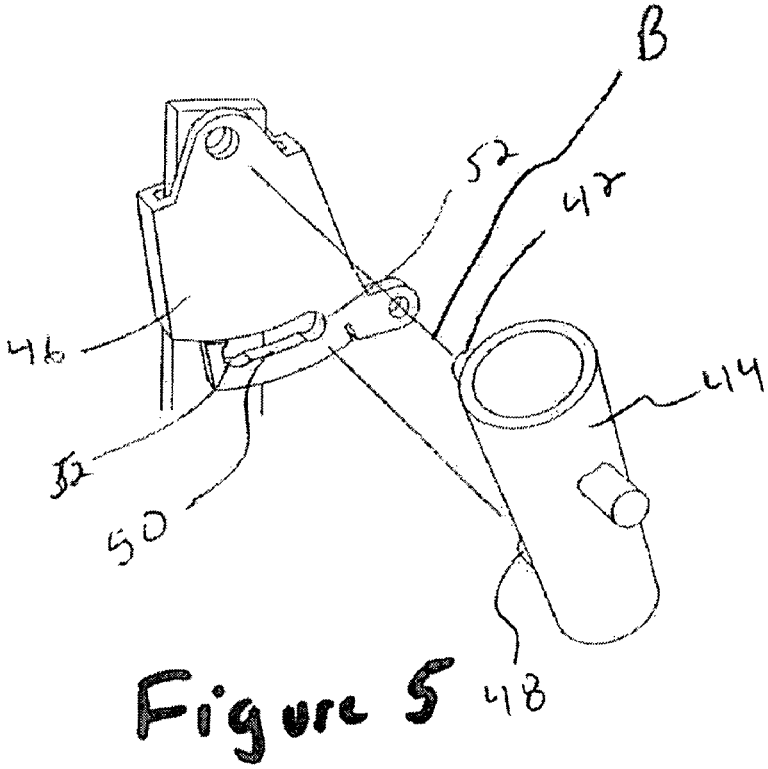
FIG. 5 is an exploded view of a drawing implement holder.
Figure 6:
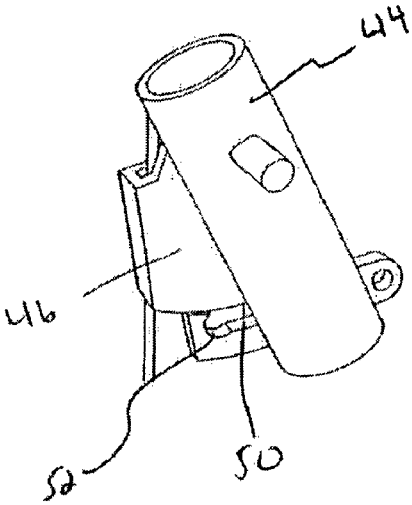
FIG. 6 is a perspective view of the drawing implement holder of FIG. 5, shown in a first position.
Figure 7:
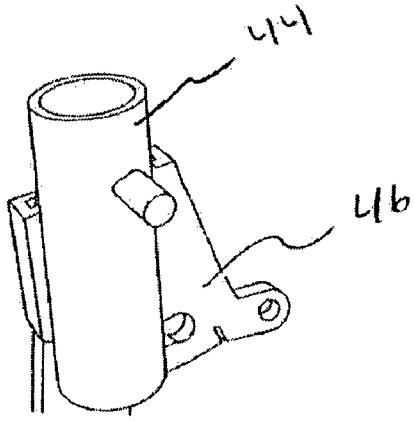
FIG. 7 is a perspective view of the drawing implement holder of FIG. 6, shown in a second position.

Referring now to FIGS. 5-7, the drawing implement holder 44 is adjustable with respect to the adapter 46. The drawing implement holder 44 has a positioning pin 48 which engages a positioning slot 50 within the adapter 46. The positioning slot 50 has at least two detents for releasably locking the drawing implement holder 44 in position with respect to the adapter 46. When the positioning pin 48 is retained in a first position (as shown in FIG. 6), the drawing implement holder 44 pivots within a range of higher angles with respect to the drawing shaft 38. When the positioning pin 48 is retained in a second position (as shown in FIG. 7), the drawing implement holder 44 pivots within a range that is closer to the drawing shaft 38.

Referring now to FIGS. 1-4, pivoting of the drawing implement holder 44 with respect to the drawing shaft 38 is facilitated by a connector 54 which mechanically engages with both the drive gear 32 and the adapter 46. The connector 54 engages the adapter 46 at a location spaced away from the pivot pin 42. The connector 54 is attached to the drive gear 32 by a connector pin 56, which is spaced away from the drive axis A on the drive gear 32. As a result of the space between the drive axis A and the connector pin 56, the connector pin 56 orbits the drive axis A when the drive gear 32 rotates. Although a generally arcuate connector 54 is shown here, the connector may have any suitable shape.

Because the drawing mechanism 40 pivots about the pivot pin 42, only the back and forth motion (motion which is perpendicular to the pivot axis B) of the connector pin 56 is translated to the drawing implement holder 44 by the connector 54. Lateral motion of the connector pin 56 (motion which is parallel to the pivot axis B) is not transferred to the drawing mechanism 40 due to a freely rotating connection between the connector 54 and the connector pin 56, as well as a slight amount of lateral play found in the connection between the connector 54 and the adapter 46.

As the result of the mechanical connection between the drive gear 32 and the drawing mechanism 40, the drawing implement holder 44 pivots as the rotating mechanism 26 rotates with respect to the housing 12. The rate of pivot with respect to the rate of rotation can be adjusted by moving the connector pin 56 with respect to the drive axis A. Generally, the drawing mechanism 40 will pivot more when the connector pin 56 is spaced away from the drive axis A and less when the connector pin 56 is positioned close to the drive axis A.

Figure 2:
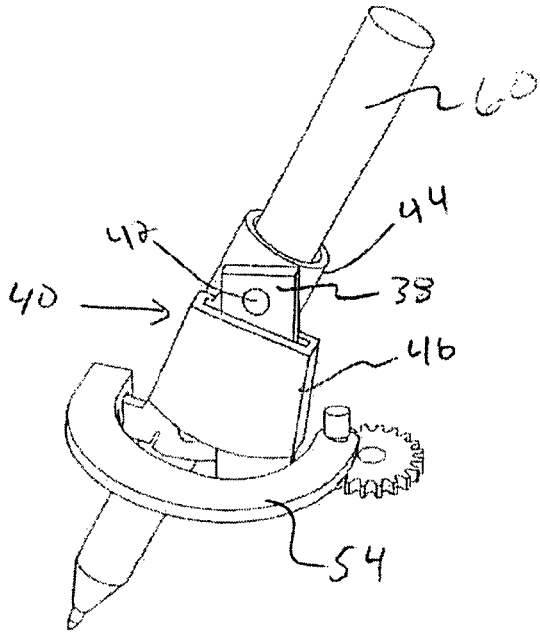
FIG. 2 is a perspective view of a portion of the drawing apparatus of FIG. 1 shown in a first position.
Figure 3:
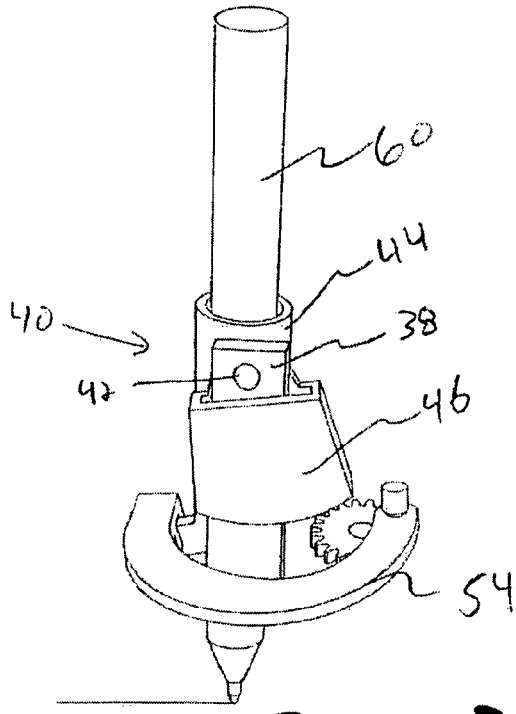
FIG. 3 is a perspective view of the portion of the drawing apparatus of FIG. 2 shown in a second position.

As best seen in FIGS. 2-4, a drawing implement 60, such as a marker, crayon, pencil or other implement, is preferably inserted in the drawing implement holder 44. The drawing implement holder 44 may have a sensor or switch which prevents operation of the drawing apparatus 10 when no drawing implement is inserted in the drawing implement holder 44. The fit between the drawing implement holder 44 and the drawing implement 60 may be frictional or loose such that the drawing implement is only retained therein by gravity. Alternatively, there may be some locking mechanism for retaining the drawing implement 60.

As seen in FIG. 1, the cover portion 16 has an aperture 58 positioned to facilitate insertion and withdrawal of a drawing implement. Preferably, the aperture 58 is large enough to facilitate pivoting and revolving of the drawing implement 60 without interference. The first and second plates 28, 36 also have apertures (not shown) to allow the drawing implement 60 to extend therethrough and contact the supporting surface. Preferably, the writing implement is removable through the aperture 58. Removal of the writing implement may occur during operation, facilitating the interchanging of writing implements to create a pattern using multiple writing implements.

A battery 62 is located on the first plate 28 and electrically connected to the motor 30. Preferably, the battery 62 is also connected to at least one switch (not shown). As mentioned above, a switch may be located in the drawing implement holder 44, such that the drawing apparatus 10 will not operate unless a drawing implement 60 is positioned therein. Alternatively, or in combination therewith, a switch (not shown) may be located in the base 14 or on the bottom surface of the second plate 36 to facilitate operation of the drawing apparatus 10 only when the apparatus 10 is properly positioned on a supporting surface.

Although a battery powered electric motor 30 is shown here, there may be alternative sources of energy for movement of the drawing apparatus 10. By way of example, a wind up mechanism, light/solar system or the like may be used.

Figure 8:
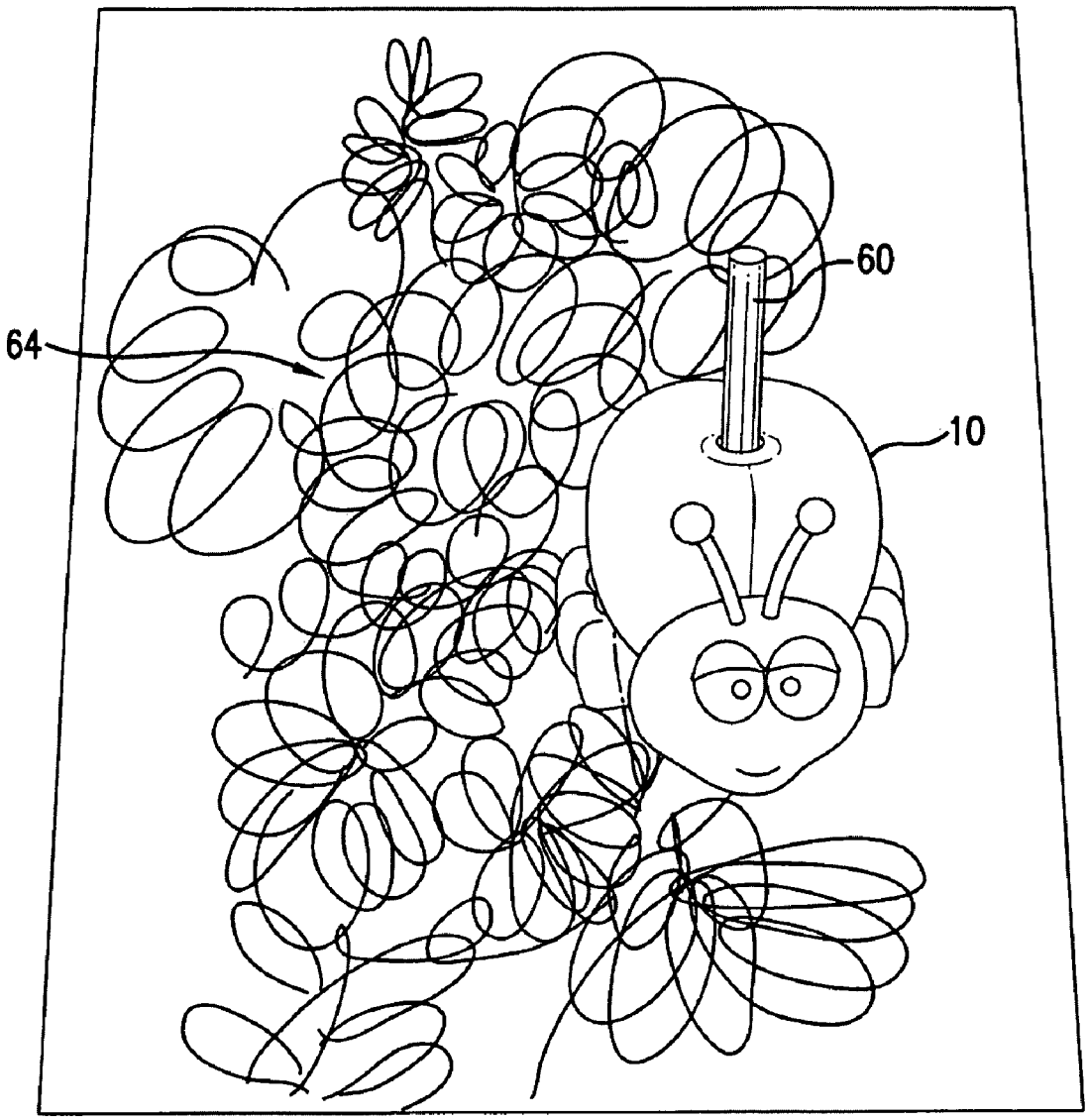
FIG. 8 is a perspective view of a drawing apparatus shown with markings on a supporting surface.

It is preferable that at least a portion of the bottom surface of the second plate 36 is positioned at the same level as the bottom of the base 14 to facilitate contact of the second plate 36 with the supporting surface. The second plate 36 may have a spring mount or some other "soft" engagement with the supporting surface, such that when a user pushes down on the housing 12 thereby holding the drawing apparatus 10 in place, the rotating mechanism 26 will still rotate within the housing 12. The relationship between the second plate 36 and the supporting surface is also preferably such that when the drawing apparatus 10 is permitted to operate freely on a supporting surface, there is limited slippage between the second plate 36 and the supporting surface. Referring now to FIG. 8, the limited slippage may produce a random pattern of markings 64 as the drawing apparatus 10 moves about the supporting surface. The slippage and thus the pattern of markings produced may be controlled by springs or other positioning means.

To operate the drawing apparatus 10, a drawing implement 60 is placed in the drawing implement holder 44 and the drawing apparatus 10 is placed on a supporting surface. If the operation of the drawing apparatus 10 is not initiated by placement on a supporting surface, the user may operate a switch to turn the drawing apparatus 10 on. Once activated, the user may hold the drawing apparatus 10 in place, move the drawing apparatus 10 across the supporting surface, allow the drawing apparatus 10 to move freely or some combination thereof.

The supporting surface may be a piece of paper, cardboard, chalkboard or any other surface that a user desires to mark. Although not necessary, it is preferable that the supporting surface be generally flat.

While in the foregoing detailed description of this disclosure has been described in relation to certain representative structures thereof, and many details have been set forth for purposes of illustration, it will be apparent to those skilled in the art that the disclosure can be varied considerably without departing from the basic principles of the disclosure.

The invention claimed is:

1. A drawing apparatus comprising:

a housing having a circumferential ring gear located within an interior portion of the housing;

a rotating mechanism rotatably mounted within the housing, the rotating mechanism having a motor operatively connected to a drive gear, said drive gear rotating about a drive axis and positioned for engagement with the ring gear; and a drawing mechanism pivotally mounted on the rotating mechanism, said drawing mechanism having a drawing implement holder connected to the drive gear by a connector mounted to a portion of the drive gear spaced away from the drive axis;

wherein, upon rotation of the rotating mechanism with respect to the housing, the drawing implement holder mechanism pivots with respect to the rotating mechanism.

2. The drawing apparatus according to claim 1, wherein the motor has an output shaft driving a series of gears mechanically connecting the motor to the drive gear, thereby facilitating rotational movement of the rotating mechanism and pivoting movement of the drawing implement holder when the output shaft of the motor rotates.

3. The drawing apparatus according to claim 1, further comprising a cover portion having an aperture extending therethrough and generally aligned with the drawing implement holder to facilitate insertion of a drawing implement into the drawing implement holder.

4. The drawing apparatus according to claim 1, wherein the rotating mechanism further comprises a mounting shaft extending substantially upwardly therefrom, said mounting shaft having a mounting pivot for pivotally mounting the drawing mechanism thereto.

5. The drawing apparatus according to claim 4, further comprising an adjusting connector pivotally mounted to the mounting shaft at said pivot point, said adjusting connector having at least two engagement points for engagement with the drawing implement holder and releasably retaining the drawing implement holder in one of at least two positions with respect to the adjusting connector.

6. The drawing apparatus according to claim 1, further comprising a cover portion adapted to mate with the housing, wherein said housing and cover portion resemble an insect.

7. The drawing apparatus according to claim 1, wherein, when a bottom portion of the housing is engaged with a supporting surface, the rotating mechanism is spaced from the supporting surface and the drawing implement holder facilitates engagement of the drawing implement with the supporting surface.

8. The drawing apparatus according to claim 1, wherein the connector is a pushrod having a generally arcuate profile.

9. The drawing apparatus according to claim 1, further comprising a power source providing power to the motor.

10. A drawing apparatus comprising:

a base having a circumferential ring gear located within an interior portion of the base, said base being adapted for engagement with a supporting surface;

a cover portion adapted to mate with the base and having an aperture extending therethrough;

a rotating mechanism rotatably mounted within an interior cavity formed by the base and cover portion, the rotating mechanism having a motor mechanically connected to a drive gear, said drive gear rotating about a drive axis and positioned for engagement with the ring gear; and a drawing mechanism pivotally mounted on the rotating mechanism, said drawing mechanism having a drawing implement holder mounted adjacent the aperture extending through the cover portion and connected to the drive gear by a pushrod mounted on a portion of the drive gear spaced away from the drive axis;

wherein, upon rotation of the rotating mechanism with respect to the base, the drawing implement holder mechanism pivots with respect to the rotating mechanism.

11. The drawing apparatus according to claim 10, wherein engagement between the base and the supporting surface causes activation of the motor, thereby rotating the rotating mechanism with respect to the base.

12. The drawing apparatus according to claim 10, wherein the rotating mechanism further comprises apertures therein that facilitates insertion of a drawing implement therethrough.

13. The drawing apparatus according to claim 10, wherein a lower portion of the rotating mechanism engages a supporting surface when the drawing apparatus is in an upright position.

14. The drawing apparatus according to claim 13, wherein engagement between the lower portion of the rotating mechanism and the supporting surface causes activation of the motor, thereby rotating the rotating mechanism with respect to the base.

15. The drawing apparatus according to claim 14, wherein the rotation of the rotating mechanism results in controlled slippage of the lower portion with respect to the supporting surface.

16. A method of drawing comprising:

providing a drawing apparatus having a shell, a rotating mechanism mounted within the shell for rotation with respect to the shell and a pivoting drawing implement holder mounted on the rotating mechanism, the rotating mechanism powered by a motor that is activated when a lower portion of the rotating mechanism engages a supporting surface and the drawing implement holder pivoting with respect to the rotating mechanism;

inserting a drawing implement into the drawing implement holder; and placing the drawing apparatus on a supporting surface, thereby activating the motor and facilitating rotation of the rotating mechanism and pivoting of the drawing implement holder.

17. The method according to claim 16, wherein the drawing implement holder pivots at a predetermined rate as a function of the rotation of the rotating mechanism.

18. The method according to claim 17, further comprising adjusting the rate of pivoting of the drawing implement holder.

19. The method according to claim 16, further comprising holding the shell of the drawing apparatus in a stationary position with respect to the supporting surface, thereby facilitating marking of the supporting surface by the drawing implement around a central point.

20. The method according to claim 16, further comprising allowing the drawing apparatus to move freely with respect to the supporting surface, thereby facilitating marking of the supporting surface by the drawing implement as the drawing apparatus moves about the supporting surface.

* * * * *